US006059203A

United States Patent [19]

Streicher et al.

[11] Patent Number: 6,059,203

[45] Date of Patent: May 9, 2000

[54] VALVE ASSEMBLY WITH CONCENTRICALLY LINKED COMPONENTS AND FUEL INJECTOR USING SAME

[75] Inventors: James J. Streicher, Pontiac; David E. Martin, Normal; Jeffrey R. Ries, Metamora, all of Ill.

[73] Assignee: Caterpillar Inc., Peoria, Ill.

[21] Appl. No.: 09/146,028

[22] Filed: Sep. 3, 1998

[51] Int. Cl.[7] ..... F02M 59/00

[52] U.S. Cl. ..... 239/533.2; 239/88; 137/627.5

[58] Field of Search ..... 137/627.5, 625.27; 239/533.8, 88; 123/506, 467

[56] References Cited

U.S. PATENT DOCUMENTS

| | | | |
|---|---|---|---|
| 2,840,110 | 6/1958 | Parsons | 137/625.27 |
| 2,858,840 | 11/1958 | Wright, Jr. | 137/627.5 X |
| 2,985,490 | 5/1961 | Gates | 137/627.5 X |
| 3,802,626 | 4/1974 | Regneault et al. | 239/533.8 X |
| 3,908,621 | 9/1975 | Hussey | 123/139 |
| 4,167,168 | 9/1979 | Yamamoto | 123/139 |
| 4,448,169 | 5/1984 | Badgley | 126/467 |
| 4,640,252 | 2/1987 | Nakamura | 123/446 |
| 4,684,067 | 8/1987 | Cotter | 239/533.3 |
| 4,750,462 | 6/1988 | Egler | 123/467 |
| 4,951,703 | 8/1990 | Brehm | 137/315 |
| 4,962,887 | 10/1990 | Matsuoka | 239/95 |
| 5,135,027 | 8/1992 | Miki | 137/596.17 |
| 5,160,116 | 11/1992 | Sugiura | 251/129.14 |
| 5,241,935 | 9/1993 | Beck | 123/300 |
| 5,263,645 | 11/1993 | Paul et al. | 239/533.8 X |
| 5,355,856 | 10/1994 | Paul | 123/446 |

FOREIGN PATENT DOCUMENTS

| | | | |
|---|---|---|---|
| 692533 | 8/1964 | Canada | 137/627.5 |
| 1119730 | 6/1956 | France | 137/627.5 |
| 1211480 | 3/1960 | France | 137/627.5 |
| 4115477 | 11/1991 | Germany | 239/533.8 |
| 331648 | 9/1958 | Switzerland | 137/625.27 |

*Primary Examiner*—David J. Walczak
*Attorney, Agent, or Firm*—Michael B. McNeil

[57] ABSTRACT

A valve assembly includes a first body with a first conical valve seat and a locating bore centered about a first axis. A second body is press fit attached to the first body and has a second conical valve seat with a second axis positioned in opposition to the first conical valve seat. An elongated valve member with a centerline has an upper conical valve surface and a lower conical valve surface trapped between the first conical valve seat and the second conical valve seat. A guide portion of the elongated valve member moves in a guide bore defined by one of the first body and the second body. The first axis, the second axis and the centerline are concentrically linked via the press fit attachment of the second body in the locating bore of the first body. The valve assembly is preferably utilized as a needle control valve assembly in a fuel injector.

20 Claims, 3 Drawing Sheets

VALVE ASSEMBLY WITH CONCENTRICALLY LINKED COMPONENTS AND FUEL INJECTOR USING SAME

TECHNICAL FIELD

The present invention relates generally to alignment of valve assembly components, and more particularly to fuel injectors with control valve assemblies having concentrically linked components.

BACKGROUND ART

In order to decrease undesirable exhaust emissions and improve performance, there has been a trend in the fuel injection industry to decouple the injection timing from the crankshaft position of the engine. In most instances, this is accomplished by incorporating an electronic control valve that is controlled in its activation and deactivation by a conventional electronic control module. Because of the relatively extreme environments encountered within fuel injectors, these control valves are typically made up of a plurality of hardened metallic components that are machined and fitted to relatively tight tolerances.

In some instances, fuel injector control valves include an elongated valve member that moves between a pair of opposing conically shaped valve seats. Because the valve member is trapped between the opposing valve seats, such a valve assembly must necessarily include at least three separate components; a first valve body component having a machined upper seat is mated to a second body component having a lower valve seat after the elongated valve member is positioned between the two seats. In order to reduce stress from side forces and ensure proper sealing when the valve member is seated against the upper or lower conically shaped valve seats, it is typically necessary that the centerlines of the valve seats and that of the valve member be as concentrically aligned as possible. Because of the current limitations in machining technology and the necessity to have some tolerancing bounds for any mass produced multi-component device, there is always room for improving the concentric alignment of multi-component valve assemblies.

There are currently several methods known in the art for aligning valve components. Among these are the use of outer alignment rings and/or the use of internal alignment dowels. While both of these methods can be utilized to successfully align components in a valve assembly, they are often cumbersome and usually require very close attention to tolerancing details.

The present invention is directed to overcoming these and other problems associated with concentrically aligning components in valve assemblies.

DISCLOSURE OF THE INVENTION

A valve assembly includes a first body with a first conical valve seat and a locating bore centered about a first axis. A second body is press fit attached to the first body and has a second conical valve seat with a second axis positioned in opposition to the first conical valve seat. An elongated valve member with a centerline has an upper conical valve surface and a lower conical valve surface trapped between the first conical valve seat and the second conical valve seat. A guide portion of the elongated valve member moves in a guide bore defined by one of the first body and the second body. The first axis, the second axis and the centerline are concentrically linked via the press fit attachment of the second body in the locating bore of the first body.

BEST MODE FOR CARRYING OUT THE INVENTION

Figure 1:
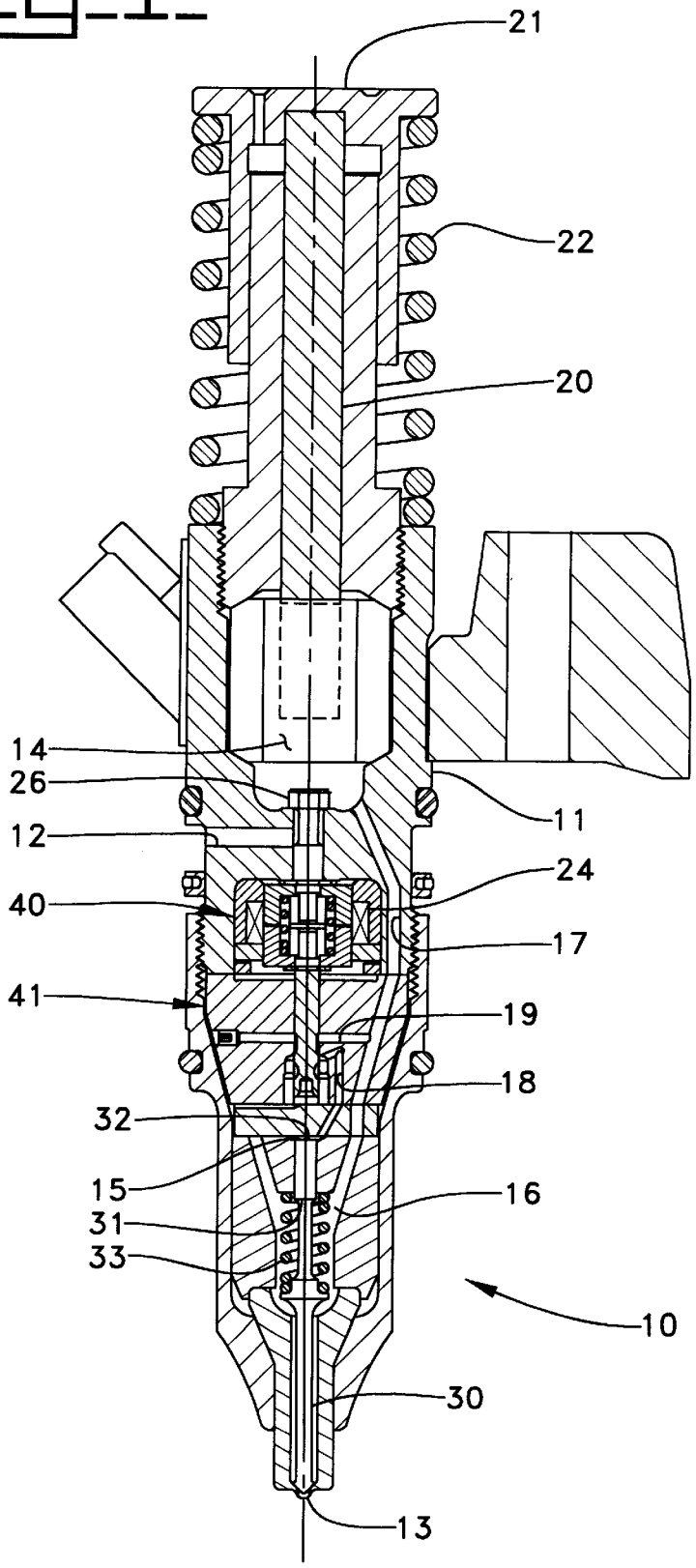
FIG. 1 is a sectioned front diagrammatic view of a fuel injector having a valve assembly according to the present invention.

Referring now to FIG. 1, a fuel injector 10 includes an injector body 11 that defines a fuel inlet/spill port 12 and a nozzle outlet 13. When a plunger 20 and a tappet 21 are driven downward by a conventional cam and rocker arm assembly (not shown) fuel is displaced from a fuel pressurization chamber 14. Between injection events, a tappet return spring 22 retracts plunger 20 and tappet 21 toward their retracted positions, as shown, which causes fresh fuel to be drawn into fuel pressurization chamber 14 past a spill valve member 26. When plunger 20 is undergoing its downward pumping stroke and spill valve member 26 is closed, fuel in fuel pressurization chamber 14 is pressurized to an injection pressure and travels to nozzle outlet 13 via a nozzle supply passage 17 and a nozzle chamber 16.

A needle valve member 30 is positioned in nozzle chamber 16, and is normally biased downward to block nozzle outlet 13 by a needle biasing spring 33. Needle valve member 30 can move upward to an open position to allow fuel to spray out of nozzle outlet 13 during an injection event. Needle valve member 30 includes a lifting hydraulic surface 31 exposed to fluid pressure in nozzle chamber 16, and a closing hydraulic surface 32 exposed to fluid pressure in a needle control chamber 15. Depending upon the positioning of a needle control valve assembly 41, needle control chamber 15 is open to either a source of high pressure or low pressure. When needle control chamber 15 is open to a low pressure passage 37, needle valve member 30 behaves as a simple spring biased check valve; however, when needle control chamber 15 is open to a source of high fluid pressure, such as the high pressure in nozzle chamber 16 during an injection event, needle valve member 30 becomes biased toward its closed position. Both needle control valve assembly 41 and spill valve member 26 are controlled by a single solenoid 24 as part of an overall control valve 40.

Figure 2:
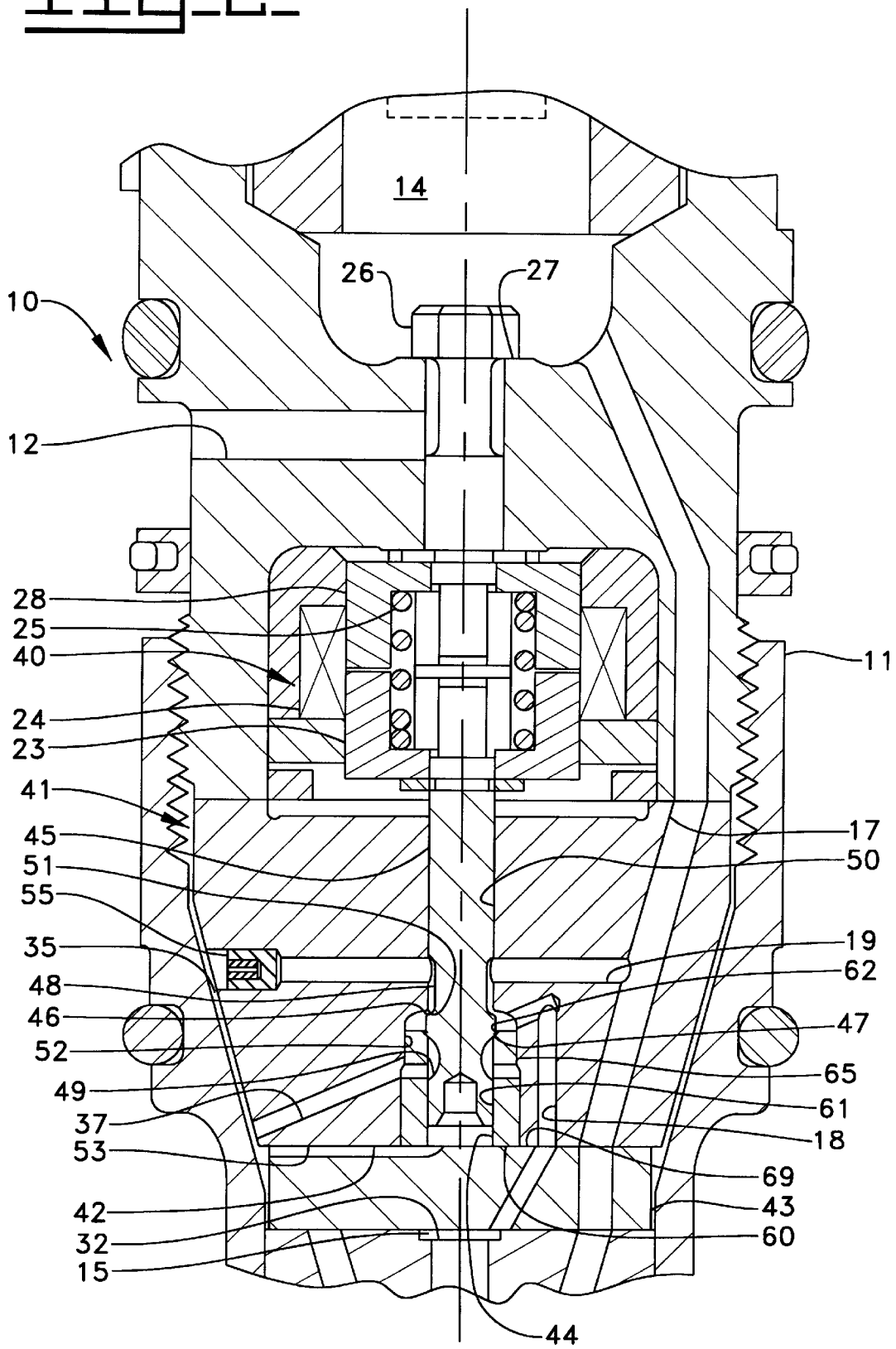
FIG. 2 is an enlarged front sectioned diagrammatic view of the control valve portion of the fuel injector shown in FIG. 1.

Referring now in addition to FIG. 2, the structure, components and plumbing surrounding control valve 40 is illustrated. Control valve 40 includes a single solenoid 24 that has a first armature 28 separated from a second armature 23 by a biasing spring 25. Thus, when solenoid 24 is de-energized, first and second armatures 28 and 23 are biased away from one another. When solenoid 24 is energized, armatures 28 and 23 are drawn toward one another against the action of biasing spring 25. Spill valve member 26 is attached to move with first armature 28, and is normally biased to a position away from a spill valve seat 27 to open fuel pressurization chamber 14 to fuel inlet/spill port 12. Spill valve member 26 is drawn downward to close spill valve seat 27 when solenoid 24 is energized. In addition, the exposed area of spill valve member 26 is sized such that it will remain in its closed position against the action of biasing spring 25 even when solenoid 24 is de-energized when fuel pressure in fuel pressurization chamber 14 is above a pre-determined threshold magnitude.

Second armature 23 is attached to move with an elongated valve member 45. Valve member 45 includes an upper conical valve surface 46 and a lower conical valve surface 47 that are trapped between an upper conical valve seat 51 and a lower conical valve seat 62. A needle control passage 18 opens on one end to needle control chamber 15 and on its other end to an area between upper and lower conical valve seats 51 and 62, respectively. When elongated valve member 45 is seated to close lower conical valve seat 62, needle control chamber 15 is exposed to fluid pressure in nozzle supply passage 17 via a high pressure communication passage 19, an upper annulus 48 and needle control passage 18. When solenoid 24 is energized and elongated valve member 45 is moved upward to close upper conical valve seat 51, needle control chamber 15 is exposed to the always relatively low fluid pressure in fuel inlet/spill port 12 via an annular low pressure area 35, low pressure passage 37, a lower annulus 49 and needle control passage 18.

Figure 3:
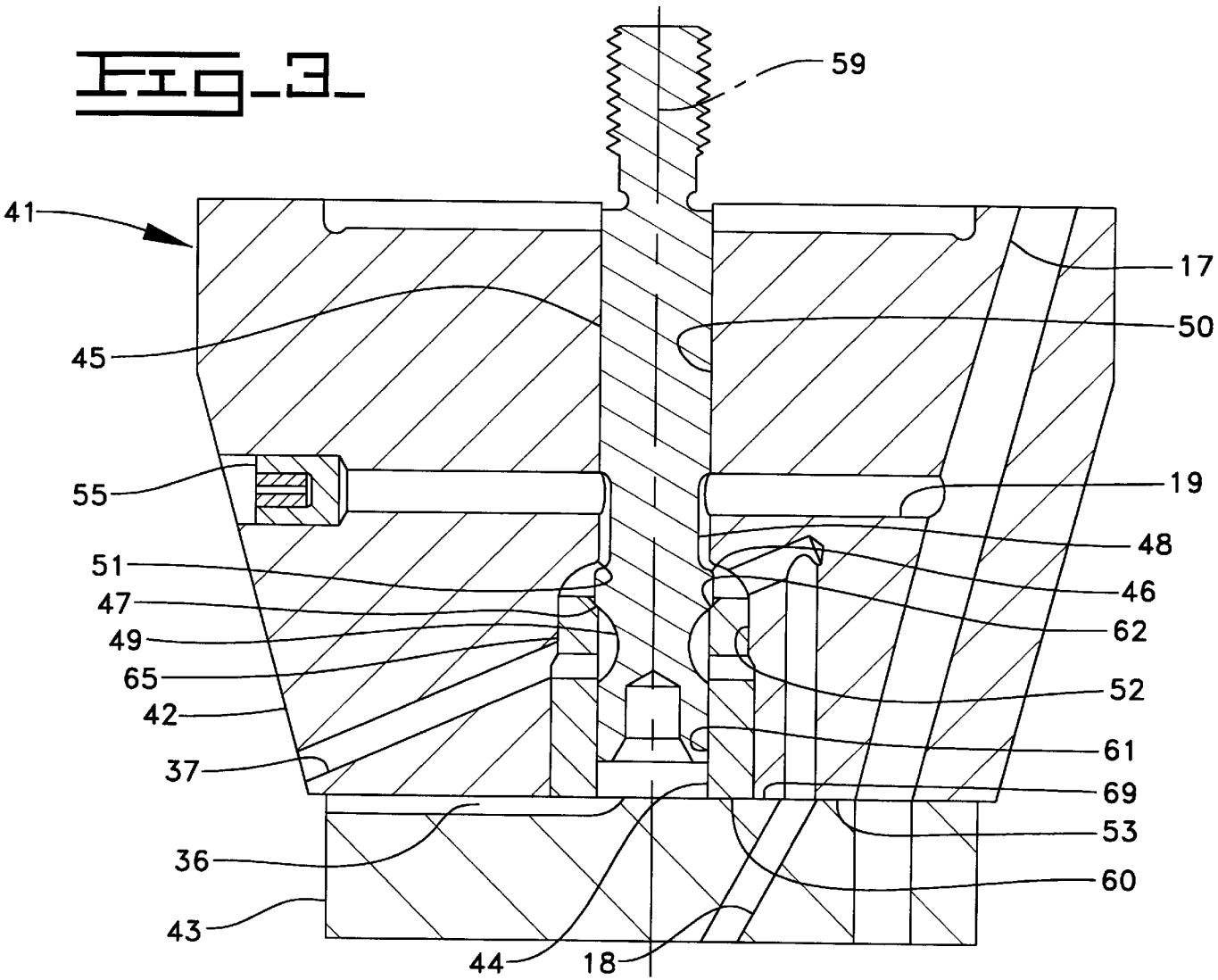
FIG. 3 is a front sectioned diagrammatic view of a valve assembly according to the present invention.

Referring now in addition to FIG. 3, needle control valve assembly 41 includes an upper stop component 42, an alignment ring/lower stop component 44, a check stop plate component 43 and elongated valve member 45. Upper stop component 42 is machined to include nozzle supply passage 17, high pressure communication passage 19, a portion of needle control passage 18, and low pressure passage 37. A plug 55 is positioned to close one end of high pressure communication passage 19. Either after or before these various passageways are machined, upper stop component 42 is also machined, preferably in a single chucking, to include an upper guide bore 50, a press fit locating bore 52 and upper conical valve seat 51. Upper guide bore 50 preferably has a diameter just larger than that of elongated valve member 45 so that a relatively tight clearance exists to guide valve member 45 in its movement. Because these central features are preferably machined in a single chucking, they share a virtually concentric common centerline 59.

In order to link the centerline of elongated valve member 45 and its upper conical valve surface 46, with that of concentric centerline 59, elongated valve member has a cylindrical outer surface 65 that is sized to have a relatively tight clearance in the area of upper guide bore 50. This relatively tight clearance concentrically links valve surface 46 to upper valve seat 51. After elongated valve member 45 is positioned in upper stop component 42, alignment ring/lower stop component 44 is press fit attached into locating bore 52.

In order to concentrically link the centerline of lower conical valve seat 62 to that of elongated valve member 45 and upper conical valve seat 51, alignment ring/lower stop component 44 is preferably machined in a single chucking to include a lower guide bore 61, lower conical valve seat 62 and a cylindrical outer surface 65 that is sized to closely match the diameter of locating bore 52. The upper and lower conical valve seats are concentrically linked to one another through the press fit attachment of cylindrical outer surface 65 to that of press fit locating bore 52.

In order to ensure that the vertical separation distance between upper conical valve seat 51 and lower conical valve seat 62 is maintained to within a relatively tight tolerance, both upper stop component 42 and alignment ring/lower stop component 44 rest against check stop plate component 43. This is accomplished during manufacture by machining upper stop component 42 to include a bottom planer surface 53, and machining upper conical valve seat 51 at a precise location relative to bottom planer surface 53 along concentric centerline 59. In addition, lower conical valve seat 62 is preferably machined a precise distance away from a bottom planer surface 60 of alignment ring/lower stop component 44. When the two pieces are joined in a press fit attachment, a precise separation distance is maintained between the upper and lower valve seats by making bottom planer surface 53 and bottom planer surface 60 co-planer, and maintaining this relationship by their respective contact with a top planer surface 69 on check stop plate component 43. Thus, the various valving surfaces of needle control valve assembly 41 are concentrically linked and precisely located relative to one another via the interaction of the press fit attachment, the contact between various planer surfaces, and the preferable single chucking machining of the key features.

INDUSTRIAL APPLICABILITY

Referring again to FIGS. 1–3, each injection event begins when plunger 20 and tappet 21 are driven downward. At this time, solenoid 24 is de-energized so that fuel pressurization chamber 14 is open to fuel inlet/spill port 12, and needle control chamber 15 is open to pressure communication passage 19. When it is desired to raise fuel pressure, solenoid 24 is briefly energized to pull spill valve member 26 downward to close spill valve seat 27. At the same time, elongated valve member 45 moves upward to close upper conical valve seat 51 and open lower conical valve seat 62 so that needle control chamber 15 is now open to low pressure passage 37. If the solenoid is maintained in an energized state, fuel pressure will eventually exceed a valve opening pressure sufficient to lift needle valve member 30 upward to an open position against the action of needle biasing spring 33 to commence the spraying of fuel out of nozzle outlet 13. When it is desired to end the injection event, solenoid 24 is de-energized, which allows elongated valve member 45 to move downward under the action of biasing spring 25 to a position that closes lower conical valve seat 62 and opens upper conical seat 51 so that needle control chamber 15 is now exposed to the high pressure existing in pressure communication passage 19. This allows needle valve member 30 to quickly move downward under hydraulic forces on closing hydraulic surface 32 and the action of biasing spring 33 to quickly close nozzle outlet 13.

If a higher initial injection pressure is desired, solenoid 24 is de-energized briefly at the beginning of the injection event before fuel pressure in fuel pressurization chamber 14 has risen to a level sufficient to open needle valve member 30. The solenoid 24 is de-energized after fuel pressure is above a threshold sufficient to hydraulically hold spill valve member 26 in its closed position. Thus, while solenoid 24 is briefly de-energized, spill valve member 26 remains closed so that fuel pressure can continue to build, but needle control chamber 15 is exposed to this building fuel pressure via pressure communication passage 19, and hence needle valve member 30 remains in its downward closed position. After the fuel pressure has reached a desired level, the injection event can begin by again energizing solenoid 24 to now expose the closing hydraulic surface 32 of needle valve member 30 to the low pressure in low pressure passage 37. Those skilled in the art will appreciate that a split injection event can be created by waiting to briefly de-energize solenoid 24 after some amount of fuel has commenced to spray out of the injector.

While the fuel injector according to the present invention works in substantially the same manner as some prior art equivalent fuel injectors, the concentrically linked components of the needle control valve assembly, render the overall injector easier to reliably manufacture on large scales with even tighter valve tolerancing than that realistically possible with prior art control valve assemblies. While the valve assembly according to the present invention has been illustrated as a needle control valve in one type of fuel injector, those skilled in the art will appreciate that the concepts of the present invention can be applied to virtually any multi-component valve assembly that uses an elongated valve member trapped between upper and lower conically shaped valve seats that require close concentric alignment. Thus, the present invention could find potential application in a wide variety of valving applications other than the fuel injector shown in the preferred embodiment.

The above description is intended for illustrative purposes only, and is not intended to limit the scope of the present invention in any way. Various modifications could be made to the disclosed embodiment without departing from the intended spirit and scope of the present invention, which is defined in terms of the claims set forth below.

What is claimed is:

1. A valve assembly comprising:

a first body with a first conical valve seat and a locating bore centered about a first axis;

a second body press fit attached to said first body and having a second conical valve seat with a second axis positioned in opposition to said first conical valve seat;

an elongated valve member with a centerline, and having an upper conical valve surface and a lower conical valve surface trapped between said first conical valve seat and said second conical valve seat;

a guide portion of said elongated valve member being slideably guided in a guide bore defined by one of said first body and said second body; and said first axis, said second axis and said centerline being concentrically linked via the press fit attachment of said second body in said locating bore of said first body.

2. The valve assembly of claim 1 wherein said first body has a first planar surface located a fixed distance from said first conical valve seat;

said second body has a second planar surface located a fixed distance from said second conical valve seat; and said first planar surface and said second planar surface are parallel.

3. The valve assembly of claim 2 wherein said first planar surface is a bottom surface of said first body;

said second planar surface is a bottom surface of said second body; and said first planar surface and said second planar surface are coplanar.

4. The valve assembly of claim 1 further comprising a solenoid attached to one of said first body and said second body, and including an armature attached to said elongated valve member.

5. The valve assembly of claim 1 further comprising a third body mounted in flush contact with said first body and said second body.

6. The valve assembly of claim 1 wherein said elongated valve member defines an upper annulus located above said upper conical valve surface and a lower annulus located below said lower conical valve surface;

said first body defining a first passage that opens to said upper annulus, and a control passage that opens to a control cavity defined between said first conical valve seat and said second conical valve seat; and said second body defining a second passage that opens to said lower annulus.

7. The valve assembly of claim 6 further comprising a solenoid attached to one of said first body and said second body, and including an armature attached to said elongated valve member;

said first body has a first planar surface located a fixed distance from said first conical valve seat;

said second body is completely received in said locating bore and has a second planar surface located a fixed distance from said second conical valve seat; and said first planar surface and said second planar surface are coplanar.

8. The valve assembly of claim 1 wherein said locating bore and said first conical valve seat are machined into said first body in a single chucking; and said second body having a cylindrically shaped press fit portion and said second conical valve seat machined in a single chucking.

9. A control valve assembly comprising:

a first body with a first conical valve seat centered about a first axis;

a second body having a second conical valve seat centered about a second axis and being positioned in opposition to said first conical valve seat;

an elongated valve member with a centerline, and having an upper conical valve surface and a lower conical valve surface trapped between said first conical valve seat and second conical valve seat;

said first body and said second body being attached to one another via a press fit attachment of one of said first body and said second body into a locating bore defined by the other of said first body and said second body;

said first axis, said second axis and said centerline being concentrically linked via said press fit attachment;

a solenoid attached to one of said first body and said second body, and including an armature attached to said elongated valve member;

at least one of said first body, said second body and said elongated valve member defining a high pressure passage, a low pressure passage and a control passage; and said elongated valve member being slideably guided between a first position in which said high pressure passage is open to said control passage, and a second position in which said low pressure passage is open to said control passage.

10. The control valve assembly of claim 9 wherein said first body has a first planar surface located a fixed distance from said first conical valve seat;

said second body has a second planar surface located a fixed distance from said second conical valve seat; and said first planar surface and said second planar surface are parallel.

11. The control valve assembly of claim 10 wherein said first planar surface is a bottom surface of said first body;

said second planar surface is a bottom surface of said second body; and said first planar surface and said second planar surface are coplanar.

12. The control valve assembly of claim 11 wherein said high pressure passage includes an upper annulus defined by said elongated valve member;

said low pressure passage includes a lower annulus defined by said elongated valve member; and said control passage opens on one end between said first conical valve seat and said second conical valve seat.

13. The control valve assembly of claim 12 further comprising a third body with a planar surface mounted in contact with said first planar surface of said first body and said second planar surface of said second body.

14. A fuel injector comprising:

an injector body that defines a nozzle outlet and includes a first body with a first conical valve seat and a second body with a second conical valve seat;

a solenoid attached to said injector body and including an armature;

an elongated valve member attached to said armature and having a first conical valve surface and a second conical valve surface trapped between said first conical valve seat and said second conical valve seat;

said first body and said second body being attached to one another via a press fit attachment of one of said first body and said second body into a locating bore defined by the other of said first body and said second body;

said first conical valve seat having a first axis, said second conical valve seat having a second axis, and said elongated valve member having a centerline; and said first axis, said second axis and said centerline being concentrically linked via said press fit attachment.

15. The fuel injector of claim 14 wherein said injector body further includes a third body with a planar contact surface;

said first body has a first surface in contact with said planar contact surface and located a fixed distance from said first conical valve seat; and said second body has a second surface in contact with said planar contact surface and located a fixed distance from said second conical valve seat.

16. The fuel injector of claim 15 wherein said first surface is a bottom surface of said first body;

said second surface is a bottom surface of said second body; and said first surface and said second surface are coplanar.

17. The fuel injector of claim 14 wherein at least one of said first body, said second body and said elongated valve member define a high pressure passage, a low pressure passage and a control passage; and said elongated valve member being slideably guided between a first position in which said high pressure passage is open to said control passage, and a second position in which said low pressure passage is open to said control passage.

18. The fuel injector of claim 17 wherein said injector body defines a needle control chamber connected to said control passage; and a needle valve member with a closing hydraulic surface exposed to fluid pressure in said needle control chamber, and being moveable between an open position in which said nozzle outlet is open and a closed position in which said nozzle outlet is blocked.

19. The fuel injector of claim 18 wherein said first body has a first planar surface located a fixed distance from said first conical valve seat;

said second body has a second planar surface located a fixed distance from said second conical valve seat; and said first planar surface and said second planar surface are parallel.

20. The fuel injector of claim 19 further comprising a third body with a planar contact surface in contact with said first planar surface and said second planar surface.

* * * * *